US006352438B1

(12) United States Patent
Wu

(10) Patent No.: US 6,352,438 B1
(45) Date of Patent: Mar. 5, 2002

(54) ELECTRICAL CONNECTOR WITH EASILY ASSEMBLED SHIELD

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/664,864

(22) Filed: Sep. 19, 2000

(51) Int. Cl.[7] ..... H01R 13/648
(52) U.S. Cl. ..... 439/92; 439/607
(58) Field of Search ..... 439/159, 160, 439/607–610, 92, 108, 541.5

(56) References Cited

U.S. PATENT DOCUMENTS

| | | | | | |
|---|---|---|---|---|---|
| 5,286,214 | A | * | 2/1994 | Takahashi | 439/92 |
| 6,027,348 | A | * | 2/2000 | Lai et al. | 439/92 |
| 6,174,176 | B1 | * | 1/2001 | Hong | 439/92 |
| 6,183,271 | B1 | * | 2/2001 | Yu | 439/92 |
| 6,183,273 | B1 | * | 2/2001 | Yu et al. | 439/92 |

* cited by examiner

*Primary Examiner*—Gary F. Paumen
*Assistant Examiner*—James R. Harvey
(74) *Attorney, Agent, or Firm*—Wei Te Chung

(57) ABSTRACT

A flash card connector (1) includes a dielectric housing (10), a number of terminals (20) received in the housing, a pair of metal grounding members (30), and a subassembly (70). The subassembly includes a metal shield (50) and ejecting means. The ejecting means includes a tubiform flange (52), an ejecting arm (40) rotatably connected to the shield, a push rod (60) movably received in the tubiform flange, and a spring. The housing defines a pair of recesses (12) in each side surface (105) thereof. A channel (13) is defined in each side surface of the housing, for receiving a corresponding grounding member. The shield forms two pairs of retention members (55). A first flange (511) is formed on the shield at an edge opposite to the tubiform flange. The first flange and the tubiform flange each form a grounding finger (513), for contacting the corresponding grounding members engaged in the housing. When the shield is upwardly attached to the housing, each retention member engages with the corresponding recess of the housing. The grounding fingers engage with the corresponding grounding members, thereby establishing an electrical connection with a grounding circuit of a printed circuit board on which the connector is mounted.

1 Claim, 5 Drawing Sheets

ELECTRICAL CONNECTOR WITH EASILY ASSEMBLED SHIELD

BACKGROUND OF THE INVENTION

1. Field of the Invention

The present invention relates to an electrical connector, and particularly to a flash card connector having a shield with retention members for easy attachment of the shield to a housing of the electrical connector.

2. Brief Description of the Prior Art

Conventional flash card connectors employ various processes for securing a shield to a housing thereof. For example, opposite flanges of the shield are bent inwardly. Then the shield is put onto the housing and the flanges interferentially clamp opposite sides of the housing. The various processes all require steps in addition to the steps required to otherwise assemble the connector. All such additional steps necessitate further effort and expense.

A conventional flash card connector has a shield which is mounted to a printed circuit board (PCB) by a pair of screws inserted into through holes defined on lateral forward ends of the shield. A grounding path is thereby established between the PCB, the screws, and the shield. Such means of mounting require steps in addition to the steps required to otherwise mount the flash card connector to the PCB, thereby necessitating further effort and expense.

Hence, an improved electrical connector is required to overcome the disadvantages of the prior art.

BRIEF SUMMARY OF THE INVENTION

An object of the present invention is to provide a flash card connector having a shield which can be easily and reliably attached to a housing of the connector.

Another object of the present invention is to provide a flash card connector having a shield with a tubiform flange of the ejecting means integrally formed with the shield.

A further object of the present invention is to provide a flash card connector having a shield and grounding members for conveniently grounding the shield to a printed circuit board.

To achieve the above-mentioned objects, a flash card connector of the present invention includes a dielectric housing, a plurality of conductive terminals received in the housing, a pair of grounding members, and a subassembly. The subassembly includes a metal shield and ejecting means. The ejecting means includes a tubiform flange, an ejecting arm rotatably connected to the shield at a pivot, a push rod moveably received in the tubiform flange, and a spring retained within the push rod.

The housing defines an upper surface, a bottom surface, and a pair of opposite side surfaces. Each side surface defines a pair of recesses at opposite ends thereof, and a channel between the recesses. Each grounding member is L-shaped and includes a wider lower portion, a narrower intermediate portion and a narrower upper portion. The lower portion forms a plurality of barbs at lateral edges thereof. Each grounding member engages with the corresponding channel in the housing.

The shield includes a base plate, a first flange extending from an edge of the base plate, the tubiform flange extending from an opposite edge of the base plate, and two pairs of retention members. The first flange and the tubiform flange each provide an inwardly protruding grounding finger corresponding to the channel of the housing. Each pair of retention members is located adjacent to the first flange and to the tubiform flange, respectively. Each retention member includes a tongue for engaging with the corresponding recess in the housing.

In assembly, the shield is attached to the bottom surface of the housing. The grounding fingers of the shield contact corresponding grounding members in the channels of the housing. The grounding members can be soldered onto a printed circuit board, thereby establishing an electrical connection with a grounding circuit of the printed circuit board.

Other objects, advantages and novel features of the present invention will become more apparent from the following detailed description of the present embodiment when taken in conjunction with the accompanying drawings.

DETAILED DESCRIPTION OF THE INVENTION

Figure 1:
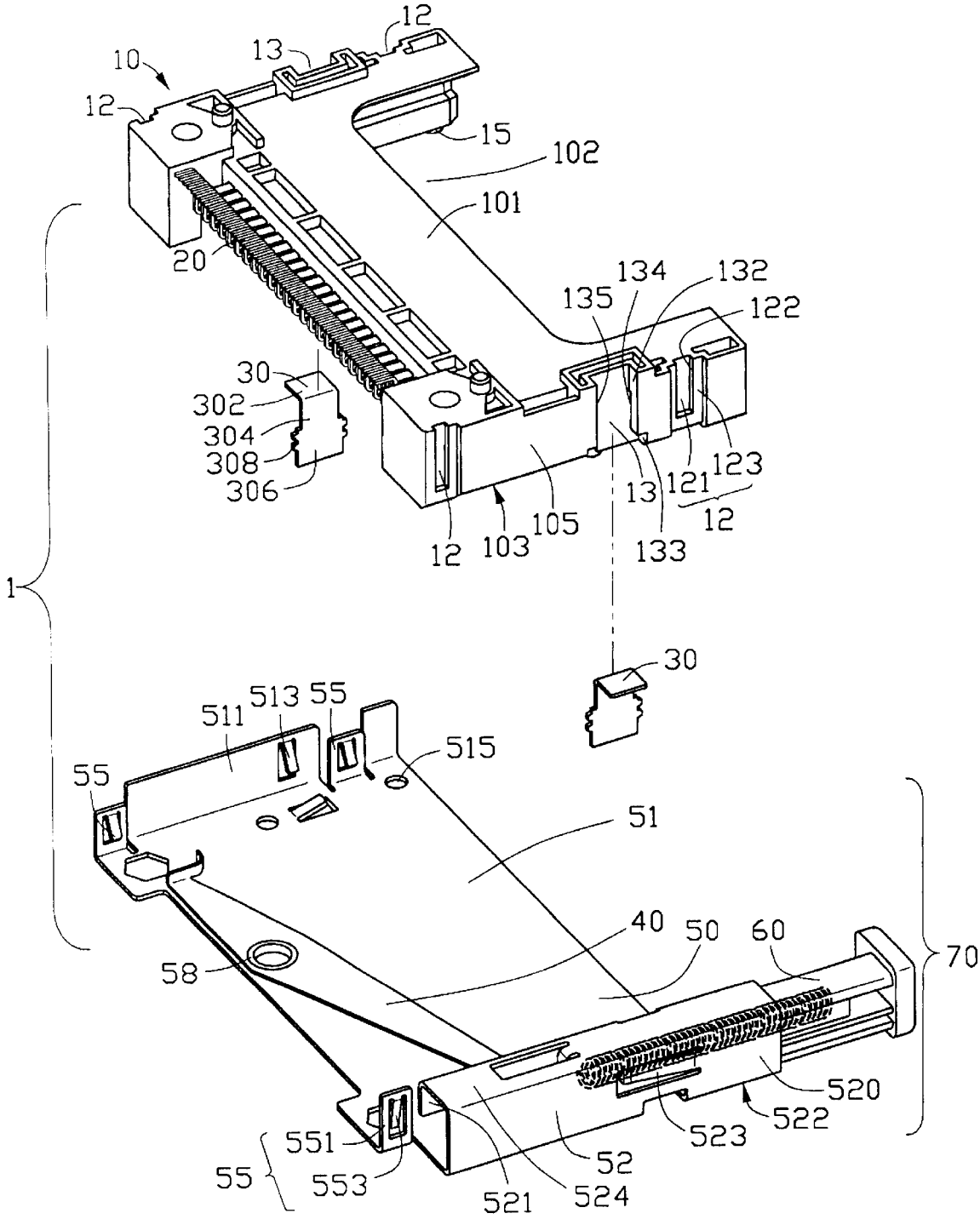
FIG. 1 is a partially exploded view of a flash card connector in accordance with a preferred embodiment of the present invention.

Referring to FIG. 1, a preferred embodiment of a flash card connector 1 of the present invention comprises a dielectric housing 10, a plurality of conductive terminals 20 received in a forward end of the housing 10, a pair of L-shaped metal grounding members 30, and a subassembly 70. The subassembly 70 comprises a metal shield 50, an ejecting arm 40, and an insulative push rod 60.

The housing 10 defines an upper surface 101, a bottom surface 103 opposite to the upper surface 101, opposite side surfaces 105 extending between the upper surface 101 and the bottom surface 103, and a space 102 defined between the surfaces 101, 103 and 105 for receiving a flash card (not shown). Each side surface 105 defines a pair of step-shaped recesses 12. One such recess 12 is located at a rearward end of each side surface 105, and the other such recess 12 is located near a forward end of each side surface 105, where the forward end is the end into which the flash card is inserted. Each recess 12 defines an inner, narrow first portion 121 and an outer, wide second portion 123. A peripheral wall 122 is formed around the first portion 121. Each side surface 105 further defines a channel 13 between the pair of recesses 12, for receiving a corresponding grounding member 30. Each channel 13 extends elongatedly between the upper surface 101 and the bottom surface 103 and is bounded by a pair of opposite first side portions 132 and a pair of opposite second side portions 133. The distance between each pair of second side portions 133 is greater than the distance between each pair of first side portions 132. A pair of posts 15 (only one visible) depends perpendicularly from each of lateral sides of the bottom surface 103.

The grounding members 30 are formed from metal plate. Each grounding member 30 includes an upper portion 302, an intermediate portion 304, and a lower portion 306. Each upper portion 302 perpendicularly bends from an upper end of the intermediate portion 304 and can be soldered to a printed circuit board (not shown) on which the connector 1 is mounted. Each lower portion 306 is wider than its adjacent intermediate portion 304. A plurality of barbs 308 is formed on opposite sides of each lower portion 306. The width of each lower portion 306 is such that the barbs 308 can securely engage with corresponding second side portions 133 of the channel 13 of the housing 10. The width of each intermediate portion 304 permits it to pass between corresponding first side portions 132 of the channel 13 of the housing 10.

Figure 2:
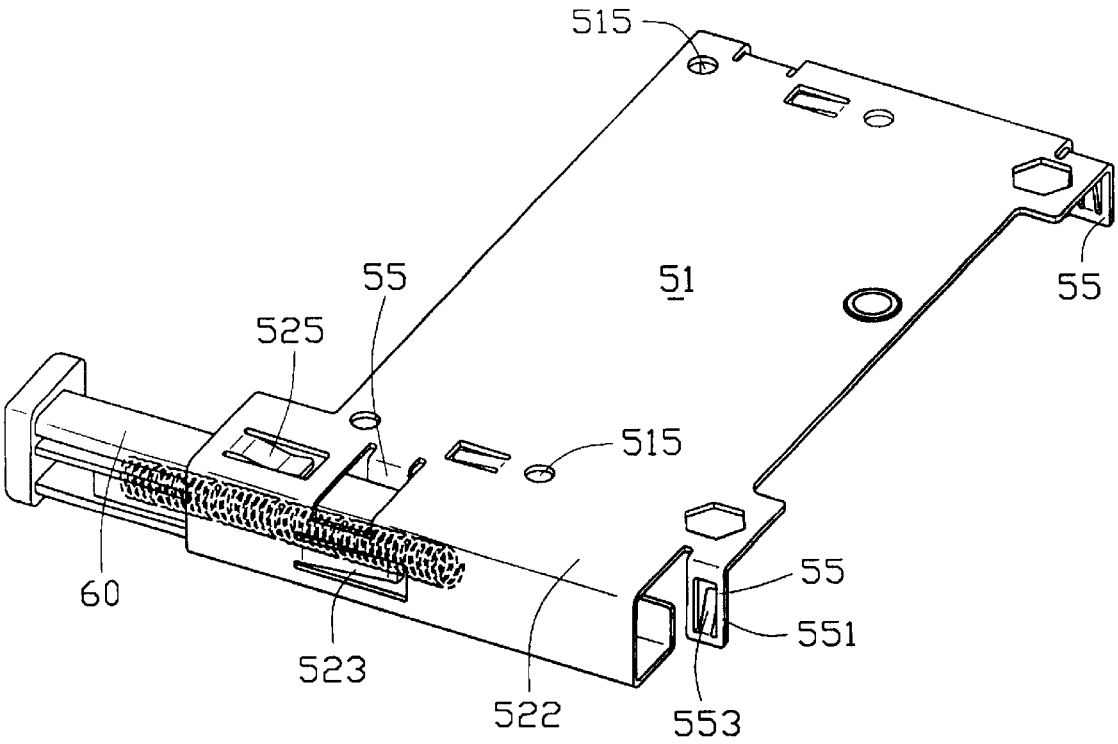
FIG. 2 is a perspective view of the subassembly shown in FIG. 1, with the subassembly inverted.

Further referring to FIG. 2, the ejecting arm 40 and the push rod 60 are preloaded onto the shield 50 to form the subassembly 70.

The shield 50 of the subassembly 70 includes a base plate 51, a first flange 511 a tubiform flange 52, and a plurality of retention members 55. The base plate 51 defines a pair of holes 515 on each lateral side thereof, corresponding to the posts 15 of the housing 10. The first flange 511 extends perpendicularly from a lateral edge of the base plate 51. A grounding finger 513 is formed in and extends downwardly and inwardly from the first flange 511. The grounding finger 513 is located to connect with the corresponding grounding member 30.

The tubiform flange 52 extends from a lateral edge of the base plate 51 opposite the first flange 511. The tubiform flange 52 comprises a bottom wall 522, an outer wall 520, a top wall 524, and an inner wall 521. The bottom wall 522 extends from and is coplanar with the base plate 51. The outer wall 520 extends perpendicularly from the bottom wall 522. The top wall 524 extends perpendicularly from the outer wall 520, forming a surface parallel to the surface of the base plate 51. The inner wall 521 depends perpendicularly from the top wall 524, forming a surface parallel to the surface of the outer wall 520. A grounding finger 513 (see FIG. 3 in dotted lines) is stamped from the inner wall 521 of the tubiform flange 52 at a location corresponding to the grounding member 30.

The tubiform flange 52 further comprises a first spring finger 523 formed in the outer wall 520, and a second spring finger 525 (see FIG. 2) formed in the bottom wall 522. The base plate 51 comprises a conventional pivot 58, which rotatably retains the ejecting arm 40 on the base plate 51. A cross block 601 is formed within the push rod 60 (see FIG. 4).

The means for ejecting an engaged flash card (not shown) from the connector 1 includes the tubiform flange 52, the push rod 60, a spring (shown in dotted lines), the cross block 601, the ejecting arm 40, and the pivot 58.

Figure 3:
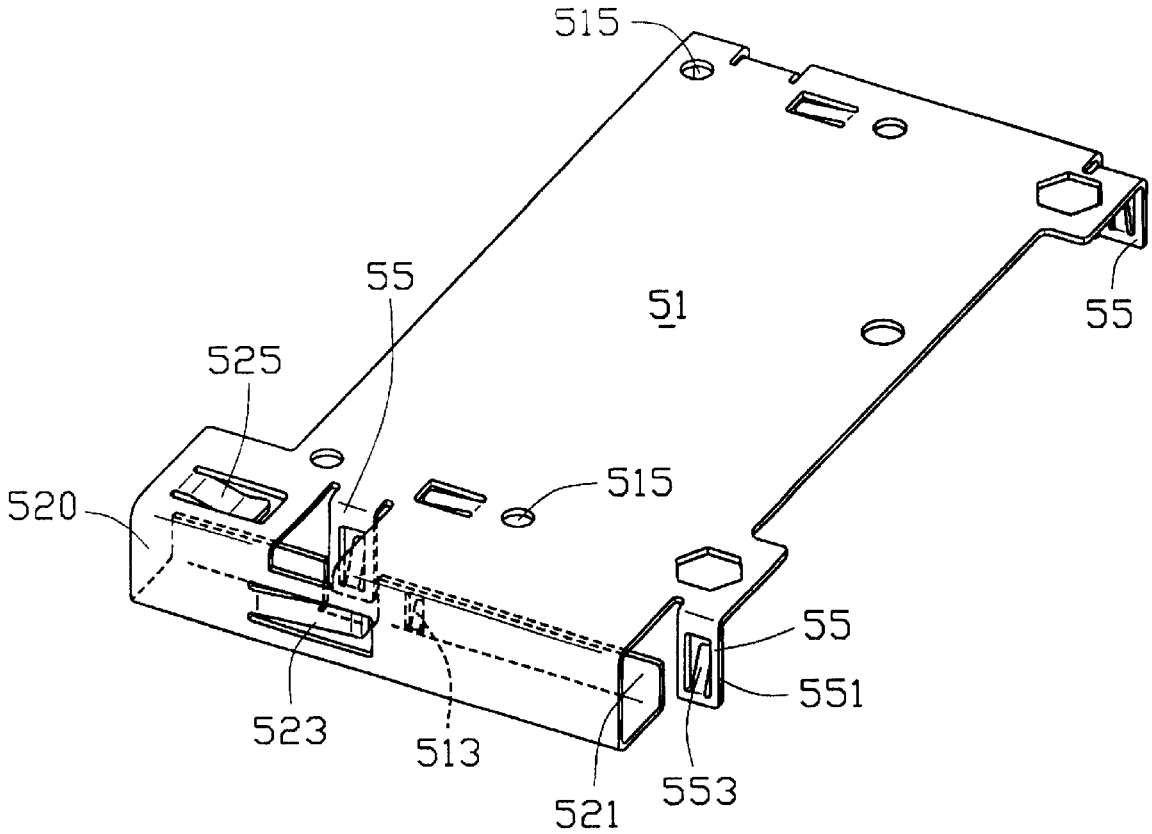
FIG. 3 is a perspective view of the shield shown in FIG. 2, showing the relationship of the retention members and the tubiform flange.

As seen in FIGS. 1, 2 and 3, a first pair of retention members 55 extends perpendicularly from a lateral side of the base plate 51, adjacent to the first flange 511. A second pair of retention members 55 extends perpendicularly form an opposite lateral side of the base plate 51, adjacent to the inner wall 521 of the tubiform flange 52. Each retention member 55 includes a fixed portion 551, and a tongue 553 projecting inwardly and downwardly from an upper portion of the fixed portion 551 (see FIG. 2). Each pair of retention members 55 are positioned to engage with the recesses 12 in a corresponding side surface 105 of the housing 10.

Figure 4:
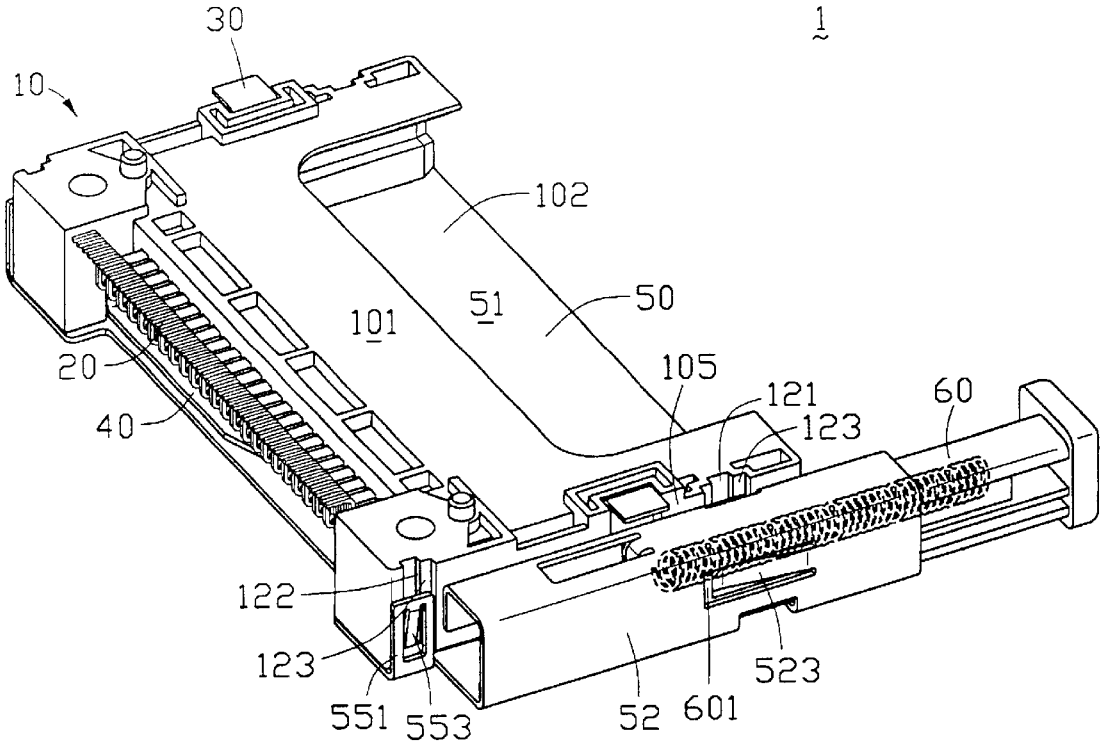
FIG. 4 is an assembled view of FIG. 1.

Further referring to FIG. 4, in assembly, the push rod 60 is movably received within the tubiform flange 52, whereby it can slide back and forth within the tubiform flange 52. The push rod 60 has a spring (shown in dotted lines) received in an inner passage thereof. The first spring finger 523 resiliently presses against a side surface of the push rod 60, while the second spring linger 525 resiliently presses against a bottom surface of the push rod 60. The first and second spring fingers 523, 525 thus cooperate to prevent the push rod 60 from wobbling within the tubiform flange 52. The ejecting arm 40 is moveably connected to the push rod 60 by conventional means, for ejecting an inserted flash card (not shown). If the push rod 60 is pushed inwardly too far, the first spring finger 523 abuts against the cross block 601, thereby preventing the push rod 60 being pushed inwardly any further.

The grounding members 30 are upwardly inserted into corresponding channels 13 of the housing 10, for connecting with a grounding circuit of a printed circuit board (not shown) on which the connector 1 is mounted. The barbs 308 of the lower portion 306 of the grounding members 30 securely engage with corresponding second side portions 133 of the channel 13. The subassembly 70 is attached to the bottom surface 103 of the housing 10 such that the posts 15 of the housing 10 extend through corresponding holes 515 of the shield 50. The first flange 511 and the inner wall 521 of the tubiform flange 52 of the subassembly 70 abut respective side surfaces 105 of the housing 10. Each retention member 55 of the subassembly 70 is now received in the corresponding recess 12 of the housing 10. The fixed portion 551 of each retention member 55 engages with the corresponding second portion 123 of the recess 12. The tongue 553 of each retention member 55 resiliently engages with the corresponding first portion 121 of the recess 12. The tongue 553 of each retention member 55 downwardly abuts against the peripheral wall 122 of the corresponding recess 12, thereby preventing accidental disengagement of the subassembly 70 from the housing 10. Thus, the subassembly 70 is securely attached to the housing 10.

The widths of the first portion 121 and the second portion 123 of each recess 12 are respectively compatible with those of the tongue 553 and the fixed portion 551 of each retention member 55. Thus each retention member 55 is reliably secured in the corresponding recess 12 of the housing 10 without lateral movement in the recess 12, thereby preventing the shield 50 from moving longitudinally relative to the housing 10.

Operators can know when the subassembly 70 has reached a correct mating position with respect to the housing 10, because they can hear and feel when the tongues 553 of the subassembly 70 have snapped into corresponding first portions 121 of the housing 10. The grounding fingers 513 of the subassembly 70 now contact with the corresponding grounding members 30, to establish a grounding path between the connector 1 and the grounding circuit of the circuit board (not shown) on which the connector 1 is mounted. The grounding members 30 also function as mounts, whereby the connector 1 can be attached to the printed circuit board (not shown) by soldering or other conventional means.

Figure 5:
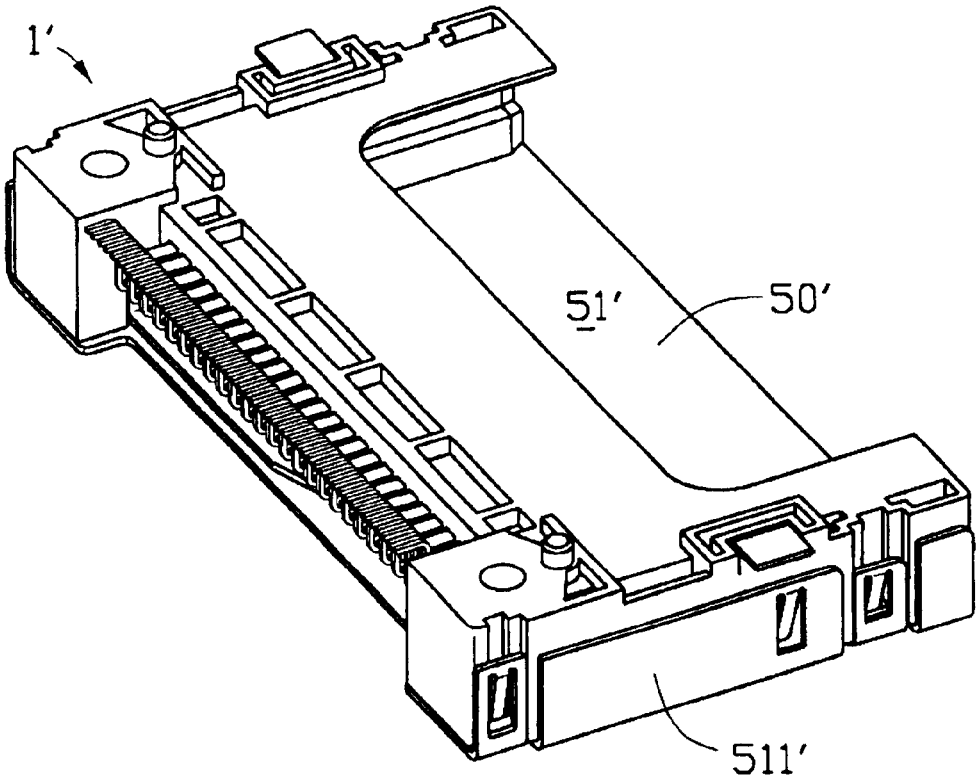
FIG. 5 is an assembled view of a flash card connector in accordance with an alternative embodiment of the present invention.

An alternative embodiment of a flash card connector 1' of the present invention, shown in FIG. 5, comprises a shield 50' similar to the shield 50 as described above, but without provision for ejecting means. In this alternative embodiment, there is no tubiform flange 52, push rod 60, spring (shown in dotted lines), cross block 601, ejecting arm 40, or pivot 58. In place of the tubiform flange 52 of the preferred embodiment, a second flange 511' extends perpendicularly from the lateral edge of the base plate 51' of the shield 50'. The second flange 511' is similar in structure to the first flange 511 of the preferred embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board, comprising:

an insulative housing defining at least a recess in a lateral side thereof;

a plurality of terminals secured in the housing; and a shield attached to the housing and providing at least a retention member at a location corresponding to said recess, said retention member being resiliently secured to said recess of the housing;

wherein the housing defines a space for receiving an electronic card, and wherein the electrical connector comprises ejecting means for ejecting the electronic card;

wherein said recess defines an inner, narrow first portion and an outer, wide second portion;

wherein said retention member comprises a first section secured in the first portion of said recess for preventing the shield from moving away from the housing, and a second section received in the second portion of said recess for preventing the shield from moving back and forth relative to the housing;

wherein the shield further includes a base plate and a first flange extending perpendicularly from the base plate, wherein the retention member extends perpendicularly from the base plate adjacent to the first flange, and wherein the first flange abuts against corresponding side surfaces of the housing and said retention member is received in the recess of the housing;

wherein the electrical connector further comprises at least a grounding member positioned on the housing, and wherein the shield forms at least a grounding finger at a location corresponding to said grounding member for electrically connecting with the grounding member; wherein the housing forms a plurality of posts depending from a surface of the housing, and the shield defines a plurality of holes for engagement with corresponding ones of the posts.

* * * * *